US007685944B2

(12) United States Patent
Kilbert et al.

(10) Patent No.: US 7,685,944 B2
(45) Date of Patent: Mar. 30, 2010

(54) CABLE TOW WHIP RIDE WITH INSIDE CURVES

(75) Inventors: Michael G. Kilbert, Canyon Country, CA (US); Larry S. McAfee, Stevenson Ranch, CA (US); David W. Crawford, Long Beach, CA (US); James H. Shull, Santa Clarita, CA (US)

(73) Assignee: Disney Enterprises, Inc., Burbank, CA (US)

( * ) Notice: Subject to any disclaimer, the term of this patent is extended or adjusted under 35 U.S.C. 154(b) by 113 days.

(21) Appl. No.: 12/110,040

(22) Filed: Apr. 25, 2008

(65) Prior Publication Data

US 2009/0266266 A1 Oct. 29, 2009

(51) Int. Cl.
*A63G 1/20* (2006.01)

(52) U.S. Cl. ..... 104/53; 104/66

(58) Field of Classification Search ..... 104/53, 104/55, 56, 58, 60, 63, 64, 66, 74, 75, 140, 104/145, 146

See application file for complete search history.

(56) References Cited

U.S. PATENT DOCUMENTS 1,450,727 A * 4/1923 Huff ..... 104/145
1,527,893 A * 2/1925 Mangels ..... 104/53
1,700,640 A * 1/1929 Mangels ..... 104/63
1,702,136 A * 2/1929 Sawers et al. ..... 104/66
3,410,223 A * 11/1968 Miller ..... 104/60
4,163,555 A * 8/1979 Norwalt et al. ..... 463/62
4,347,791 A * 9/1982 Mandros ..... 104/156
5,688,178 A 11/1997 Emrie
5,791,254 A 8/1998 Mares et al.
5,803,815 A 9/1998 Kitchen
6,269,749 B1 * 8/2001 Hogg ..... 104/53

(Continued)

OTHER PUBLICATIONS

The Whip (ride)—Wikipedia, the free encyclopedia, http://en.wikipedia.org/wiki/The_WHIP_(ride), this page was last modified on Apr. 30, 2008, retrieved on May 27, 2008, p. 1 of 1.
Ultimate Coaster, Ultimate ThrillRide.com-WHIP (Kennywood Park, West Mifflin, Pennsylvania USA) . . . , http://www.ultimatecoaster.com/spring.asp?cid=14, retrieved May 27, 2008.

(Continued)

*Primary Examiner*—S. Joseph Morano
*Assistant Examiner*—Zachary Kuhfuss
(74) *Attorney, Agent, or Firm*—Marsh Fischmann & Breyfogle LLP; Kent A. Lembke

(57) ABSTRACT

A whip ride is provided for amusement parks. A platform is provided with a guide slot extending through the platform. A drive assembly is positioned beneath the platform and includes a drive member (e.g., drive cable) moving on a constrained path. A track follows a path horizontally offset from the drive path. The drive assembly includes a bogie or drive truck mounted on the track and pivotably linked to the drive member to be driven by the drive member. A passenger whip vehicle is provided on the platform upper surface and pivotably attached via a connector extending through the guide slot to the bogie. The bogie path includes inside and outside curves, and the bogie track is vertically offset from the drive member such that its path may crossover the drive member to vary the horizontal offset and to locate the bogie track on either side of the drive member.

30 Claims, 10 Drawing Sheets

U.S. PATENT DOCUMENTS

| | | | | |
|---|---|---|---|---|
| 6,523,479 | B1 | 2/2003 | Schilke et al. | |
| 6,626,116 | B2 * | 9/2003 | Clark et al. | 104/60 |
| 7,357,727 | B2 | 4/2008 | Back | |
| 2009/0013896 | A1 * | 1/2009 | Groels | 104/75 |

OTHER PUBLICATIONS

YouTube "The Whip Amusement Park Ride" Then & Now; http://www.youtube.com/watch?v=zAlfJc2FqMQ; retrieved May 27, 2008.

* cited by examiner

CABLE TOW WHIP RIDE WITH INSIDE CURVES

BACKGROUND OF THE INVENTION

1. Field of the Invention

The present invention relates, in general, to theme or amusement park rides that simulate racing to guests, and, more particularly, to a whip ride with a design that provides a vehicle that experiences a whipping action on both inside and outside curves (or left and right turns) including an increased velocity or speed (relative to straight portions of the ride course) and, in some cases, spinning or pivoting of the vehicle (e.g., a backend of the vehicle may spin outward relative to the general direction of travel as during race car drifting).

2. Relevant Background

Amusement parks continuously seek new designs for rides to continue to attract and entertain the numbers of people that visit their parks each year. Often rides are popular if they include surprising movements or speeds and sensations not typically experienced by a visitor, e.g., quick turns or accelerations typically not felt when riding in a car on a highway or a city.

With such ride features in mind, whip rides have been popular rides for many years, with early designs being manufactured almost a hundred years ago. Whip rides are flat rides in which motors rotate two pulleys or wheels so as to move a cable or chain on an oval path. These pulleys or wheels are provided on a planar surface or platform, and a drive structure or truck (or more simply, a connection arm) is attached to the chain or cable. The drive truck is typically a rigid, triangular structure with two corners attached to the chain and a third corner riding on the platform on a caster or wheel. The third corner is offset a distance from the moving chain (such as 2 to 4 feet offset), and a vehicle or car is pivotably attached to the drive truck at or near this third corner via a tow bar. When the ride is stopped, passengers may walk across the platform to get into the vehicles. The pulleys are then rotated to cause the drive trucks to move about the oval track.

In the straight portions of the oval or straightaways, the towed vehicle follows behind the third corner of the drive truck at the speed or velocity of the chain and attached drive truck. At each end, however, the offset mounting location of the vehicle and its pivotable mounting cause the towed vehicle, which is traveling on casters (or pivotable wheels) to accelerate and travel faster than the chain as it has to travel further. As a result, the vehicle and its passengers are whipped at each end of the oval with the back end of the vehicle being spun or rotated outward in amounts that vary based on the acceleration and weight of the vehicle and its passengers. Typically, the pulleys are rotated at a constant speed such that the drive chain or cable moves at a relatively slow, constant speed such as less than about 7 feet per second. However, the whipping action causes the vehicles to accelerate to a much faster maximum speed in the corners or ends of the oval track such as up to about 15 feet per second (or over double the drive or input velocity), which can produce an exciting ride for passengers over a wide range of ages.

Unfortunately, whip rides are very predictable and repetitive, and many passengers become bored or tired of these rides after just one or two experiences. The conventional cable drive system provided on top of a platform limits the ride path to a simple oval or circle. Also, the track or course is usually relatively short such that the basic shape of the track combined with the numerous laps provides a predictable ride. Further, the attachment arm or drive truck remains or rides on one side (i.e., the outside) of the moving drive cable and, as a result, all turns are outside turns such as all left turns or right turns. Whipping only occurs at the ends of the oval track and is always in the same direction (i.e., outward from the center or inside of the track), which also may reduce enjoyment of the passengers.

Hence, there remains a need for improved whip or whip-based rides. Preferably such rides would include the acceleration and changes in speed associated with whip-like turns but also provide more variation and unpredictability to enhance the thrill and enjoyment associated with the ride thus bringing guests back for repeat visits/experiences.

SUMMARY OF THE INVENTION

The present invention addresses the above problems by providing ride systems or whip rides that contrast with prior whip rides in that whip vehicles are driven along a courseline or ride path with both left and right turns or, stated differently, with inside turns or whips in addition to conventional outside turns. The ride systems of the invention are configured with vehicles that are whipped in left and right turns and combinations of both. For example, the ride path or courseline may include an S-shaped stretch of track with full or partial corners that cause the vehicle to whip or spin its trailing or back end back and forth across the track, and the whip effect may be provided to a straight courseline, such as by altering the offset distance between a drive cable or chain and a drive bogie or truck linked to the whip vehicle.

Prior whip rides include a rigid mounting structure or arm extending outward from a rotating cable. The ride systems provide a drive system that may have a variable offset distance to provide whip effects (i.e., changes in whip vehicle speed and/or acceleration) at almost any location in a ride track (or its courseline) rather than only on the outer ends of an oval track. Another significant difference provided is that the vehicle is allowed to crossover the track centerline and, more specifically, over a track groove or slot that is at least temporarily covered during crossover to avoid catching wheels/casters and maintain a relatively smooth ride experience.

Briefly, the ride systems achieve a whip ride with inside and outside curves by use of a track and drive system for driving a bogie or drive truck that is positioned "underground" or beneath the ride platform or ride surface rather than all above a planar floor as in original whip rides. The drive truck rides on a track or guide rail beneath the ride platform with a connection shaft (or pivot arm) extending upward through a groove or slot in the ride surface, and a whip vehicle is attached to (and driven by) the bogie or drive truck via this connection shaft so as to allow the whip vehicle to pivot (e.g., 180 degrees about the shaft or a smaller range with or without stops and/or returns such as up to 90 to 120 degrees rotation about the shaft limited by a stop with coiled/resilient or other return devices). Passengers may walk across the ride surface and cannot see the drive system except for the connection shaft (or a bogie pivot or other portion of the shaft extending above or near the ride surface/platform). The "underground" or hidden drive system includes a wire rope, cable, or chain (with drive "cable" intending to mean nearly any elongate drive element such as those listed and others such as belts) that is supported by and moved at one or more cable velocities or speeds by a series of pulleys or wheels that are driven by a like number or smaller number of drive devices such as motors. In some embodiments, the cable or drive velocity is constant as was the case with prior whip rides while in other embodiments the cable velocity may be varied during the ride to achieve varying whip effects or amounts, with this velocity typically ranging from a few feet per second to up to about 10 to 15 feet per second or more.

The drive or bogie track follows the course or path of the drive cable but is offset to one side. This offset distance produces a tangential acceleration in the bogie or drive truck and any attached whip vehicle to provide the whip effect when the path of the drive cable is curved, with acceleration and bogie vehicle speed increasing in magnitude in relation to the amount or degree of the curve (e.g., a tighter or sharper curve provides a bigger whip effect while a small S-curve may be configured to provide a slight acceleration or speeding up to produce a smaller whip effect). In contrast to prior rides, the offset distance may be varied to control the particular whip effect produced with larger offsets providing larger accelerations or whip effects and/or to produce acceleration or changes in ride speed during more linear sections of a ride's courseline (e.g., vary speed of the whip vehicle even in straightaways to provide a more exciting and unpredictable ride experience).

The track is typically positioned above the drive pulleys and cable (e.g., by a vertical separation distance) and pivotably connected to the drive cable via a connection arm (e.g., the design of the drive link assembly) such that the track may actually cross over the path of the drive cable. Such drive track and cable path crossover allows the offset of the track to be reversed to the other side of the drive cable path, which also moves the relative position of the driven bogie and connected whip vehicle. The crossover and/or vertical offset of two constrained paths of the drive cable and drive track may be used to produce turns or curves in either direction (or inside and outside curves) in the ride courseline and whips in either direction (e.g., clockwise and counterclockwise rotating of the whip vehicle about its mounting or pivot point typically at the connection shaft extension attached to the bogie or drive truck). The slot or groove in the ride platform through which the connection shaft protrudes is covered in some embodiments by a chain or assembly of sliding plates (or groove covers) linked together (e.g., an arrangement of plates similar to that found in a luggage carousel) and, typically, connected to the shaft and/or the whip vehicle to travel with the vehicle. Such covering of the slot allows casters or wheels on the bottom of the whip vehicle to cross the slot without a bump and also provides a smoother walking surface for guests or passengers walking across the ride platform to enter and exit the whip vehicles.

More particularly, a whip ride system is provided for use in amusement parks and other applications to provide passengers with the exciting acceleration and variable velocity of a whip ride having whip action in either direction (e.g., inside and outside curves causing clockwise and counterclockwise rotation or skidding of the vehicle). The ride system includes a ride platform with a guide slot providing an opening or passageway from an upper surface to a space or area beneath the ride platform. A drive assembly is positioned in this space or area beneath the platform and includes a flexible drive member that travels along a first path (e.g., a cable, chain, belt, or the like driven by a series of pulleys at an input or drive velocity). A track is included in the drive assembly, and the track is arranged in or configured to have a second path or profile that is horizontally offset from the first path by an offset distance. The drive assembly also includes a bogie or drive truck mounted for movement along the track. The bogie is pivotably linked to the drive member such that it can be driven (or towed) along the track by the drive member. An elongate connector (e.g., a rod, shaft, arm, or the like) is attached to the bogie at a first end and extends upward through the slot so that a second end of the connector is accessible from or exposed to the upper surface of the ride platform. The ride assembly further includes a vehicle adapted for seating or receiving one or more passengers, and the vehicle is pivotably attached to the second end of the elongate connector such that the vehicle moves with the bogie above or on the ride platform.

According to another aspect, the first path of the drive member includes at least one inside curve (such as a left or right hand turn) and at least one outside curve (such as a right or left hand turn depending upon the direction of travel on the path). The second path or profile of the track is alternatively positioned on both sides of the first path (e.g., for a length of the first path the track may be on the right side of the drive member and for another length of the first path the track may be on the left side of the drive member). In such an embodiment, the second path may cross over the first path in at least one crossover location at which the offset distance is zero. To facilitate such crossover of the track and drive member, the track may be vertically offset a distance from a plane containing the first path of the drive member such as with the track positioned between the ride platform and the plane containing the first path. To facilitate the variability of the horizontal offset distance, the bogie is typically pivotably linked to the drive member such as with an elongate, rigid arm or rod that is pivotably mounted at one end to the bogie and at a second end to the drive member. The track may include at least one rail, and the bogie in such cases may include two or more rolling members (e.g., wheels or the like) that contact the rail to vertically support the bogie and facilitate its rolling on the track in response to movement of the linked drive member.

The drive assembly may also include a plurality of pulleys contacting and supporting the flexible drive member. These pulleys may rotate at a rate to move the flexible drive member at an input velocity on the first path, and the pulleys typically are positioned to be coplanar and in a plane that is substantially parallel to the upper surface of the ride platform (e.g., with the track being between this pulley-containing plane and the upper surface). In such an embodiment, the first and second paths may each include inside and outside curves such that the bogie travels at a velocity greater than the input velocity of the drive member in at least these curved portions to create a whip or acceleration effect in the vehicle attached to the bogie. The horizontal offset distance between the track and the drive member paths may be varied (such as by providing a curve or bend or series of curves/bends in one or both of the paths) in a corresponding or adjacent portion of the first and second paths such that velocity of the bogie relative to the input velocity is varied (e.g., the vehicle travels faster or slower than the input velocity even in "straightaways" or such variation may be provided in curves of the guide slot or bogie track to set a desired whip effect or acceleration magnitude).

A cover assembly may be included for the guide slot that includes a plurality of plates that are pivotably linked together, and the upper surface may be configured such that a recessed surface or shelf is provided for receiving the plates adjacent to or on both sides of the guide slot (e.g., such that a received plate has an exposed surface that is substantially coplanar with the upper surface of the platform). In some cases, one or more of the plates may be pivotably attached to the vehicle or second end of the connector so as to move along with the vehicle (e.g., such that casters or wheels of the vehicle contact the exposed surface of the plate(s) rather than dropping into the guide slot of the upper surface of the ride platform).

DETAILED DESCRIPTION OF THE PREFERRED EMBODIMENTS

Briefly, embodiments of the present invention are directed to ride designs and systems for use in amusement parks and similar settings to provide an enhanced and unique whip ride experience. The conventional whip ride has remained unchanged over its long history, and, while popular for some park guests, the above-ground and one-sided attachment features have resulted in a ride in which only outside turns or curves are possible, which severely limits its design with most classic whip rides being a simple oval shaped course or path. In contrast, ride systems or whip rides of the invention provide a drive system that allows inside and outside curves for whip effects in both directions (e.g., a whip vehicle that may be spun or rotated clockwise and counterclockwise about a pivot point or pivotable attachment).

In some cases, a mounting interface or assembly is provided that locates an eccentric pivot point on the vehicle directly over a drive cable driven by a series of pulleys/motors or the like. The mounting interface includes a pivot post that is towed by the cable and extends upward through a ride platform and surface for pivotable connection with the whip vehicle, such that the vehicle is able to swing around the pivot post. A mechanical limiter assembly may be provided to control the amount or range of the rotation (e.g., up to 360 degrees but more typically less such as less than about 160 degrees) and/or to dampen or control speed of rotation and/or to return the vehicle to a center or straight facing position along the main direction of travel for the whip vehicle. In other embodiments, a whip effect is created by having the pivot post or connection shaft/arm extend upward through the ride surface/platform from a bogie or drive truck. The bogie rides on a track underneath the ride platform at an offset distance from the drive cable, e.g., the bogie is connected by a linkage such as a rigid arm to the drive cable. The bogie track may be vertically offset above the path/course followed by the drive cable and the bogie pivotably mounted via the linkage to the cable. As a result, the bogie track may crossover above the cable so as to provide inside and outside curves in the path or courseline followed by the pivot post or connection shaft (e.g., the whip vehicle may crossover the main direction of travel or the courseline of the ride so as to skid or rotate in either direction). The vertical offset of the cable and the bogie or drive track also allows the offset distance to be varied as desired along the length of the ride courseline or path to accelerate or decelerate the whip vehicle (e.g., to vary the speed of the vehicle within a range relative to the typically constant drive or cable velocity) and/or to provide S-shaped or wave-shaped "straightaways" on the ride. Nearly any track shape or profile may be used with the drive system of the present invention as it allows a variable offset distance and track/cable crossover points.

Figure 1:
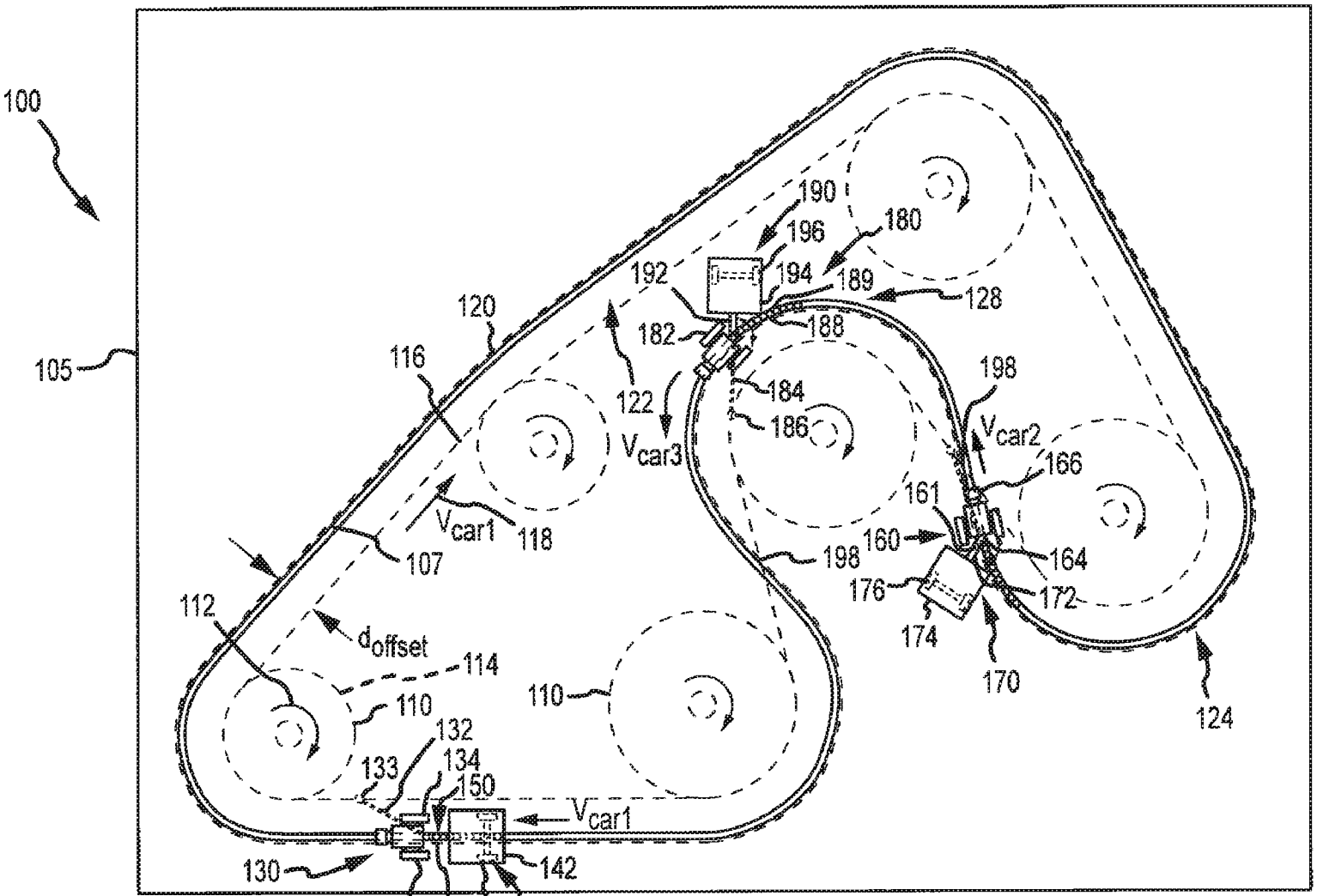
FIG. 1 is a top view of a ride system or an amusement park ride adapted to use a cable tow drive system to provide varying vehicle speeds (or whips) in outside corners and also in inside corners (e.g., a whip ride with left and right turns as well as track crossovers by the towed vehicle)

FIG. 1 illustrates a top view of a ride system or whip ride 100 of an embodiment of the invention such as may be installed at a theme or amusement park. As shown, the ride system 100 includes a ride surface or platform 105 upon which a plurality of vehicle assemblies 130, 160, and 180 ride about a ride courseline or path. The ride courseline or path is generally defined by a slot or groove 107 in this ride surface 105, and the courseline includes straight portions or straightaways 122 (with or without varying offset distance, $d_{offset}$ between a drive cable 114 and a drive or bogie track 120 both of which are beneath ground, i.e., beneath the surface or platform 105) and also outside corners or curves 124 (right turns in this case) and inside corners or curves 128 (left turns in this case).

A drive system or assembly is provided to move the vehicles 130, 160, 180 about the courseline. The drive system is mostly hidden from view in FIG. 1 as it is positioned beneath or below the surface 105 with only a pivot post/pole or connection shaft extending upward through the slot 107 (as shown as elements 134, 164, and 189, which are attached to corresponding vehicle assemblies 130, 160, 180 to drive these vehicles). A number of pulleys or drive wheels 110 are provided in the drive system such as at each corner of the courseline or otherwise, and these pulleys 110 are used to support, guide, and move an elongate, flexible drive member 116, e.g., a drive cable, wire rope, chain, belt, or the like at a velocity, $V_{cable}$, which may be a velocity that is constant in some embodiments or variable and typically is relatively low such as less that about 15 feet per second and more typically less than about 7 to 10 feet per second unless larger amounts of whip or tangential acceleration are desired and tolerable in the ride design. Some of the pulleys 110 may be free wheeling and one or more are driven to rotate 112 such as with motors or other drives 114.

Generally, the pulleys 110 are coplanar, but this is not required, and, more significantly, are positioned below (e.g., a vertical offset, $d_{Vertical\ Separation}$, shown in FIG. 3) a track 120 (alternately called drive track/rail, bogie track, and the like). This facilitates a track/cable crossover feature of the ride system 100, as discussed below, and shown in FIG. 1 at crossover locations 198 where the cable 116 runs underneath the track 120 causing the vehicles 130, 160, 180 to cross from one side of the groove 107 (or the main path of travel or courseline) to the other (e.g., also reversing the side of the offset between the track 120 and cable 116). The drive system also includes a linkage or connection arm that pivotably connects a bogie or drive truck (not shown in FIG. 1) to the cable 116 for each vehicle assembly 130, 160, 180, and the pivot posts or connection shafts 134,164, 189 are attached to and extend upward from these bogie or drive trucks through the groove 107. For example, FIG. 1 illustrates arm 132 with a pivotable connector/linkage 133 to cable 116 and to connection post 134 via a drive truck or bogie 230 shown in FIG. 2 and also shows arm 184 connecting vehicle 180 to cable 116 via pivotable connection 186. The length of the arms 132, 184 may vary widely to practice the invention but are typically of length that exceeds a maximum offset distance, $d_{offset}$, to allow a wide range of such offsets to be provided in the ride system 100 (e.g., if the offset ranges between 0 to 10 feet the arm may be 10 to 20 feet long).

In this embodiment, the vehicle assemblies 130, 160, 180 are each made up of a towing vehicle 136, 166, 182 and a towed or whip vehicle 140, 170, 190. In this embodiment, the towing vehicle 136, 166, 182 is attached to or is provided as an integral part of the pivot post or connection shaft 134, 164, 184 such that the towing vehicle 136, 166, 182 is moved along the groove 107 on wheels/casters (or above surface 105) by the shaft 134, 164, 184 (or with the underlying bogie). The towing vehicles, in other words, typically will not pivot or rotate. In contrast, the towed or whip vehicles 140, 170, 190 are mounted to the posts/shafts 134, 164, 189 specifically such that they are able to pivot or rotate about their attachment points (with the amount of rotation sometimes limited by stops and rate sometimes controlled such as with tensile or resilient members that may also be used to encourage or force a whipped vehicle back toward an original position).

Vehicle assembly 130 is traveling on a straight portion of the track courseline as it is pulled by cable 116 via linkage 132 with its velocity, $V_{CAR1}$, typically being about equal to the velocity, $V_{CABLE}$, of the cable 116, e.g., with offset, doffset, being constant but some embodiments may vary this offset distance to vary the velocity, $V_{CAR1}$. As shown, the whip car 140 is pulled behind the towing car 136 along the courseline, which generally follows the groove 107 (and track 120). The vehicle 140 includes a body 142 for receiving passengers or guests and also wheels/casters 144 that ride upon the surface 105. The vehicle 140 also includes a tow bar 146 that provides a pivotable connection to shaft 134. As will be explained in more detail below, the vehicle assembly 130 may also include a slot cover assembly 150 that may be attached to the vehicle 136 and/or to the shaft 134 to travel with the vehicle assembly 130 to provide a smooth contact surface as the whipped vehicle's casters 144 cross the groove 107, and the assembly 150 may include a number of linked but separately moveable or pivotable plates (e.g., similar to a belt in a luggage carousel or the like).

The ride system 100 includes right hand or outside turns or curves 124 and the vehicle assembly 160 is shown rounding this curve 124 and being rotated or whipped to the left or clockwise (at least originally until the vehicle moves in the opposite direction to again be aligned with towing vehicle 166 and shaft 164). In this whip position, the vehicle 170 is moved to the left side of the track 120 (and groove 107). The vehicle assembly 160 includes a towed vehicle 170 that is pivotably attached via a tow bar 172 to shaft 164 (which is attached to a bogie (not shown)), with rotation of the tow bar 172 relative to shaft or bogie mounting point 164 shown with arrow 161. The vehicle 170 also includes a body 174 for holding one or more passengers and that rides on surface 105 with casters 176. The vehicle 170 experiences tangential acceleration as it moves around the corner 124 due to offset, $d_{offset}$, and its velocity, $V_{CAR2}$, is generally greater than the velocity of the cable, $V_{CABLE}$, and the vehicle 140 when in a curved portion of track.

In operation, the whipped vehicle 170 returns from this whipped position, passes over a crossover location 198 (e.g., a portion of the ride system 100 in which the track 120 and groove 107 pass over or are transverse to the path of the cable 116), and then enters the left hand or inside turn or curve 128 and experiences an opposite direction whipping as shown with vehicle assembly 180. The vehicle assembly 180 includes a towing vehicle 182 that rides above the groove 107 (or substantially above the track 120) that is linked to pivot post or connection shaft 189, which in turn is attached to the cable 116 with connector 186. During the inside curve or left turn, the tow bar 192, which is pivotably attached to shaft 189, rotates as shown with arrow 188, such as in a counterclockwise direction or toward the right. With the tow bar 192, the body 194 of whip or towed vehicle 190 skids outward on casters or wheels 196 with the generated whip effect that provides tangential acceleration and a vehicle velocity or speed, $V_{CAR3}$, that is greater than the straightaway velocity, $V_{CAR1}$, and similar to outside curves, $V_{CAR2}$, with a similarly sized curve (e.g., curves 124 and 128 are similarly shaped and sized) and other parameters such as passenger weight, texture of surface 105 in skid area, and the like. The vehicle assembly 180 continues out of the curve 128 and passes crossover location 198 at which point the vehicle assembly 180 switches back to the other side of the track 120 and groove 107 (e.g., reverses location of offset, $d_{offset}$). With the track or courseline of ride system 100 understood or in mind, one skilled in the art will readily appreciate that numerous other track profiles or courseline configurations may be used with numerous inside and outside curves as well as areas of straight portions 122 in which the offset distance, $d_{offset}$, is varied (e.g., one or both of the cable 116 and track 120 may be non-linear to vary this offset) so as to vary and/or control the speed or velocity of the vehicles.

FIGS. 2-5 illustrate in more detail the vehicle system 130 along with portion of the drive assembly. As shown, the towing or lead vehicle 136 and towed/trailing or whip vehicle 140 ride upon the ride platform 105 above the drive assembly. A pivot post or connection shaft 134 extends upward through the platform 105 through slot 107. The slot 107 may include a through hole or opening with an adjacent shelf or recessed surface for receiving the slot cover assembly 150 including plates 152 that may be connected via opening 154 to shaft 134 to move with assembly 130 on platform 105. The whip vehicle 140 is attached to the connection shaft 134 via tow bar 146 to allow it to pivot as shown with arrow 415 relative to the shaft 134 and also relative to slot 107 and bogie track 120, which results in the trailing or back end of the body 142 sliding or moving side-to-side as shown with arrow 417. The bogie track includes upper rail 120 and also lower rail 220 (in this embodiment) and may generally be thought of as a standard track or rail that is positioned transverse (or even orthogonal) to a plane of the drive pulleys or containing the profile/path of the cable 114.

Figure 2:
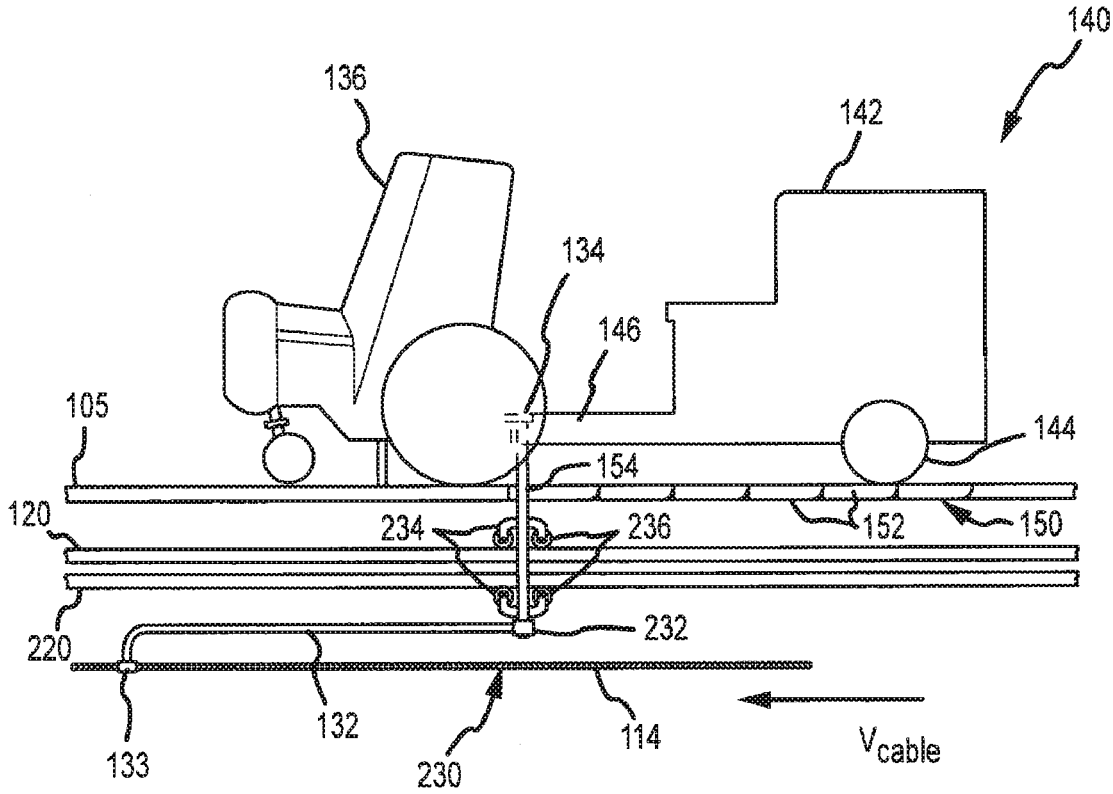
FIGS. 2-5 illustrate various more detailed views of a vehicle assembly, such as may be used in the ride system of FIG. 1, including a towing vehicle and a towed (or whipped) vehicle that are driven about a constrained path on a ride platform by a bogie or drive truck riding on a track or rail beneath the ride platform (e.g. via a post or shaft extending from the drive truck up through the ride platform), with the drive truck in turn being driven by a (rive chain or cable located at an offset from and pivotably connected to the drive truck by an elongate connector or arm.
Figure 3:
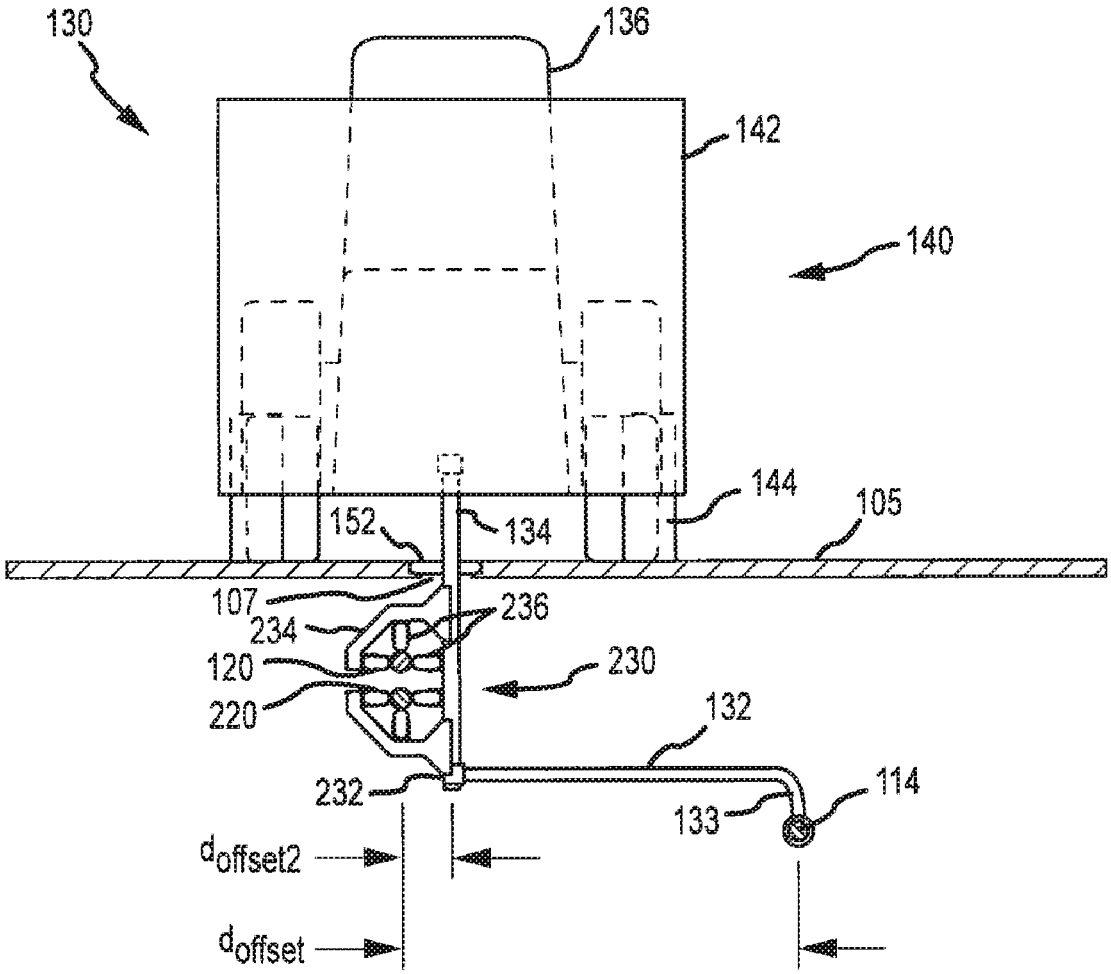

With reference to FIGS. 2 and 3, the bogie or drive truck (or bogie or truck assembly) 230 is shown to include the shaft 134 and also a frame 234 attached to the shaft 134 and extending outward from a side of the shaft 134. The frame or bogie body 234 may take numerous forms to practice the invention, and it functions to support one or more wheels or rollers 236 (here 4 rollers are used to connect to each rail 120, 220 but this may not be required in other cases). The rollers 236 act to provide a contact surface between the bogie body 234 and the rails 120, 220 and also to physically support or hang the bogie assembly 230 upon the rails 120, 220. The bogie assembly 230 is pivotably connected to the arm 132 at one end of the arm via connector or sleeve 232.

Figure 4:
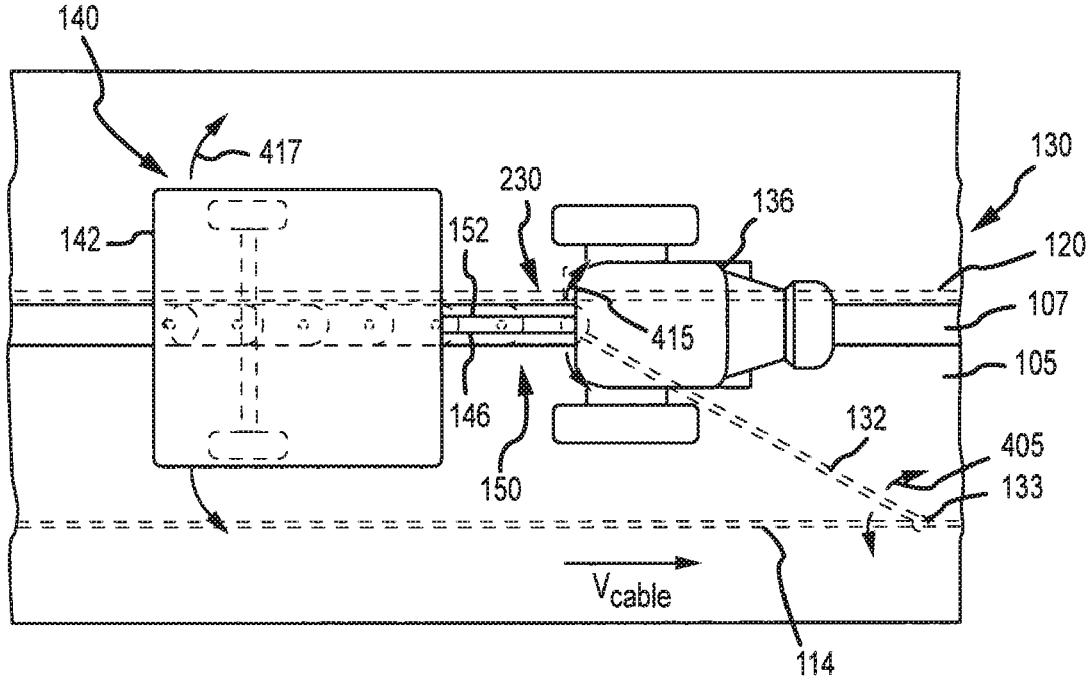
Figure 5:
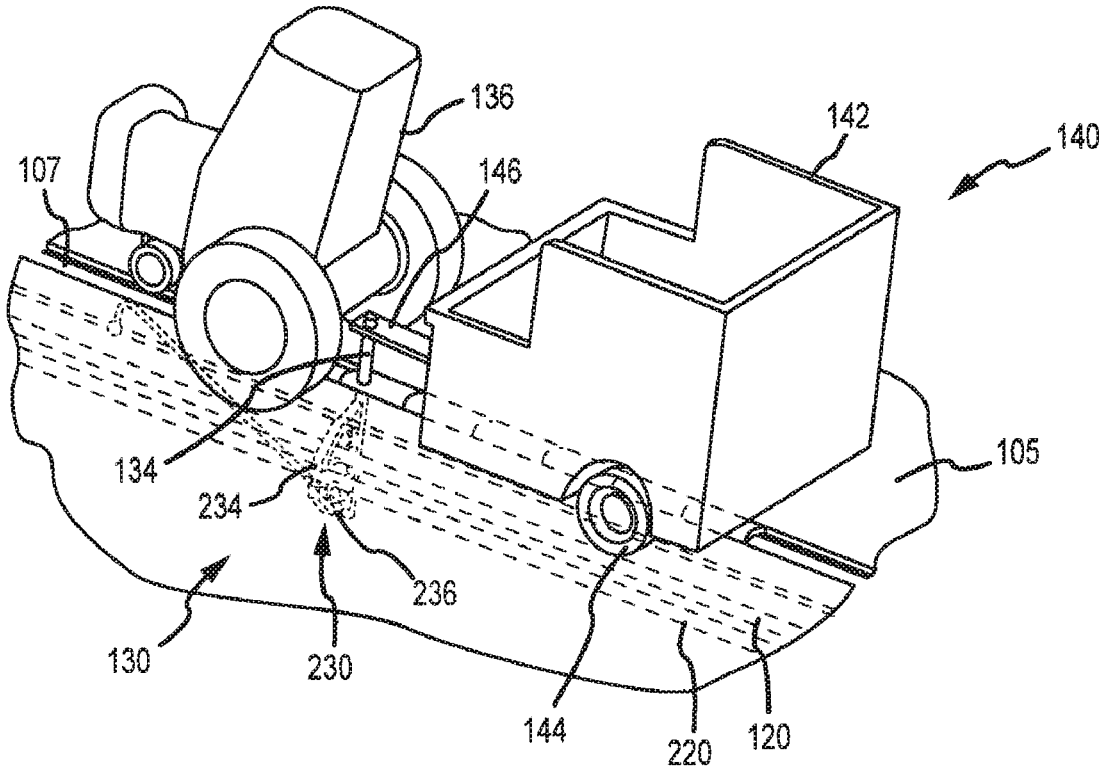
Figure 6:
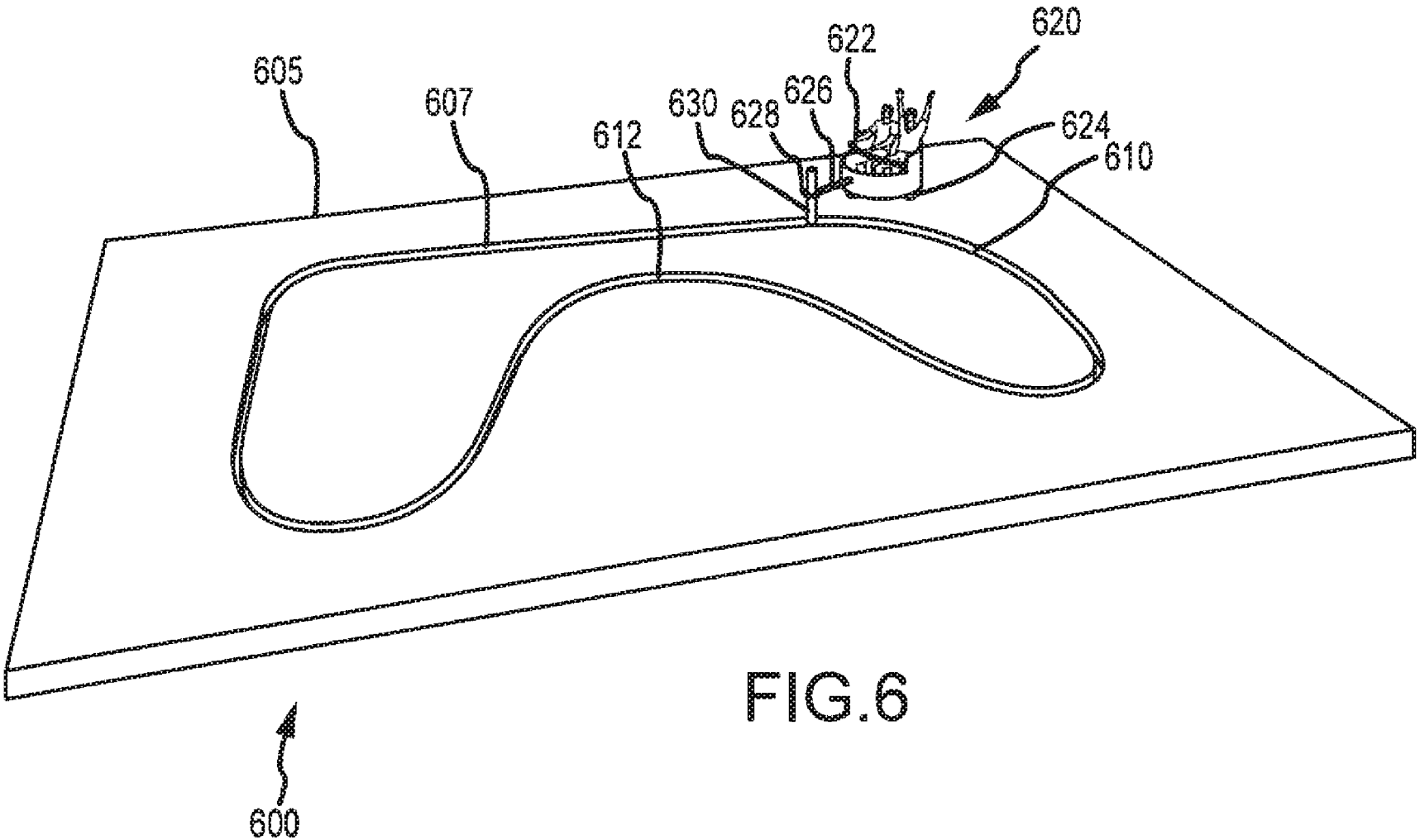
FIGS. 6-9 illustrate another embodiment of a whip ride assembly or system of the invention similar to that shown in FIGS. 1-5 but showing a single whip or ride vehicle and another design for the bogie assembly or drive truck riding on a bogie track positioned below the platform (e.g., the ride surface upon which the ride vehicle travels)

The other end of the arm 132 is pivotably connected via sleeve or connector 133 to cable 114. As shown in FIG. 4, connector is configured so as to cause arm 132 to be pulled along by cable 114 but also to allow rotation as shown with arrow 405 (e.g. in a plane parallel to the cable 114 and filly about die connection point 133 or a more limited amount such as up to about 180 degrees or up to about 120 degrees or the like). Referring again to FIGS. 2 and 3, it can be seen that the arm 132 is configured such that it is positioned above the cable 114 such that the arm 132 may rotate above the cable 114 without contact except at pivotable connection 133 (e.g., arm 132 is not in plane of cable 114). Likewise, the bogie track including the rails 120, 220 is positioned above the cable 114 (or a plane containing the cable) such that its path may cross that of the cable 114 (e.g., at crossover locations 198 shown in FIG. 1). In FIG. 3, the bottom most portion of the bogie assembly 230 (such as about the connector 232 to arm 132) is vertically offset a distance, $d_{Vertical\ Separation}$, above the cable 114 (e.g., up to several inches to several feet or more) such that when the bogie body 234 travels along the track rails 120, 220 over the rail 114 there will be no contact or interference, and the ride system 100 can include crossovers to provide inside and outside curves. The offset separation, $d_{offset}$, is typically a measure between the cable 114 and the track rails 120, 220, but a contributing portion is also the offset distance, $d_{offset2}$ between the rails 120, 220 and the extension or connection shaft 134 which indicates the location of the vehicle 140 and its pivot point in the ride system 100.

FIGS. 6-9 illustrate another embodiment of a ride system 600 of the present invention. The ride system 600 is similar to system 100 in that it includes a ride platform or upper surface 605 with a groove or slot 607 extending through the platform 605. The path of the groove or slot 607 defines a courseline or path for the ride system 600 and allows a bogie extension, shaft, or arm 630 to extend upward from an underground (or below platform) drive assembly. The bogie shaft 630 moves within the groove or slot 607, such as at cable velocity or at a differing velocity (e.g., a higher velocity) such as when subjected to a tangential acceleration as the bogie shaft 630 travels quicker than a drive cable about curves or corners. The courseline defined by the groove 607 includes straight portions but also outside curves 610 (in this case, left hand turns) and inside curves 612 (in this case, right hand turns).

Figure 7:
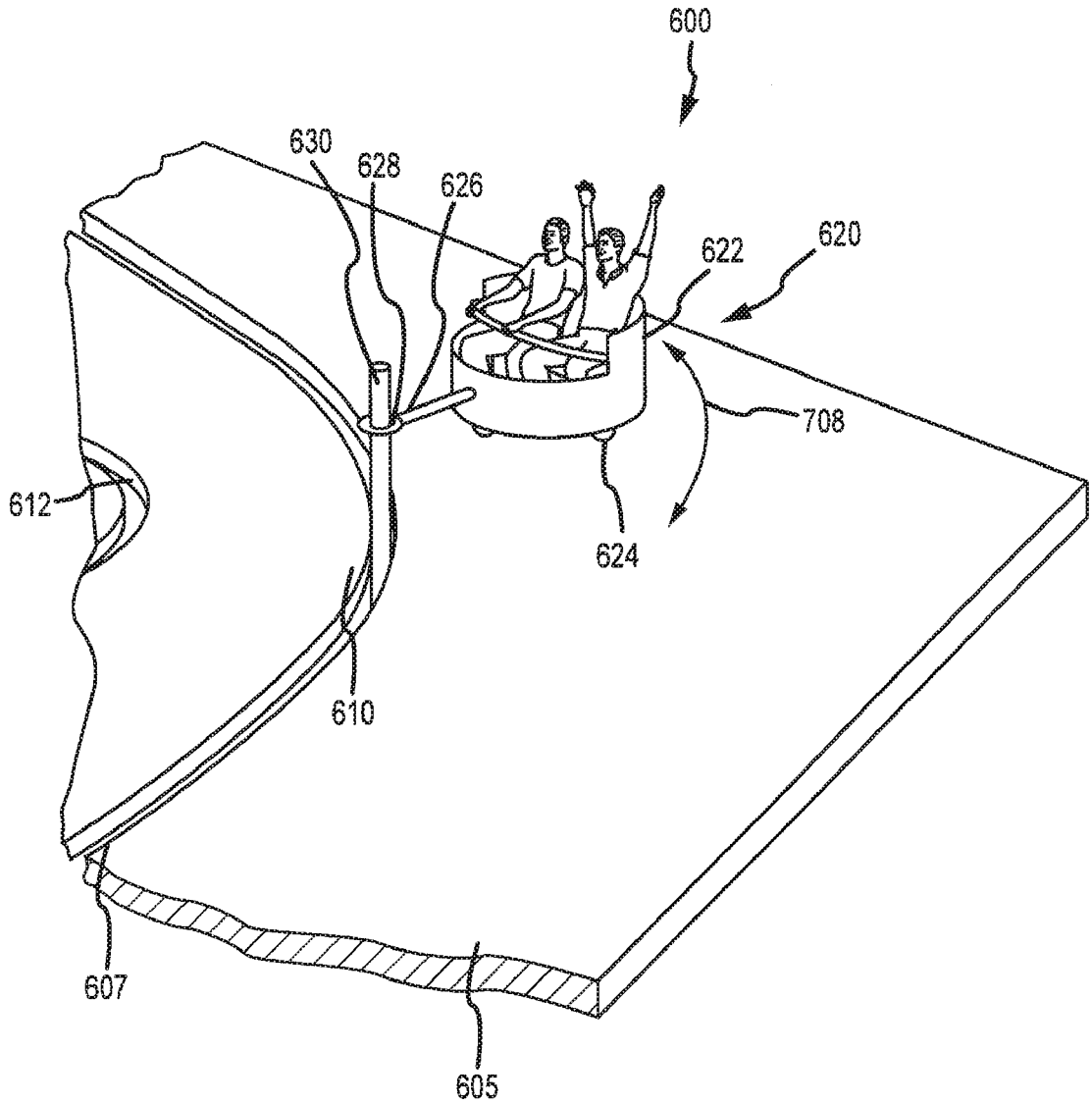

The ride system 600 includes one or more vehicles or whip vehicles 620 with a body for seating passengers. In this embodiment, the vehicle 620 rides on casters 624 on the surface 605 and is pivotably connected with sleeve or connector 628 to shaft 630 via tow bar 626 (which may be rigidly or pivotably connected to the body 622). No towing or lead vehicle is shown, but one may be provided to practice the invention. Referring to FIG. 7, it can be seen that the vehicle 620 experiences a whip effect as the post or shaft 630 is accelerated (egg., due to an offset between the bogie and the flexible drive member) about the outside curve 610. The whip effect applies a centrifugal force upon the vehicle body 622 and, especially, upon trailing or more distal portions, and this causes the body 622 to skid or slide in a right or counterclockwise direction or rotation as shown with arrow 708 (at least until the vehicle 620 travels about the curve 610 at which point it will "correct" itself to travel along the groove 607).

The amount of skid or rotation 708 will vary on a number of variables such as speed of the bogie shaft 630, the type of connection 628 (e.g., amount of resistance to rotation and the like), whether a dampening or control device is provide to resist rotation 708 and/or to encourage the vehicle 620 to remain on track 607, weight of vehicle body 622, weight of any passengers in body 622, types and conditions of casters/wheels 624, and much more. In some cases, however, the velocity increase between a straightaway and a curve such as curve 610 is up to about 50 to 100 percent or more and the range of the skid or rotation 708 is up to about 90 degrees (e.g., about a quarter revolution or less about shaft 630 by tow bar 626 and attached body 622).

Figure 8:
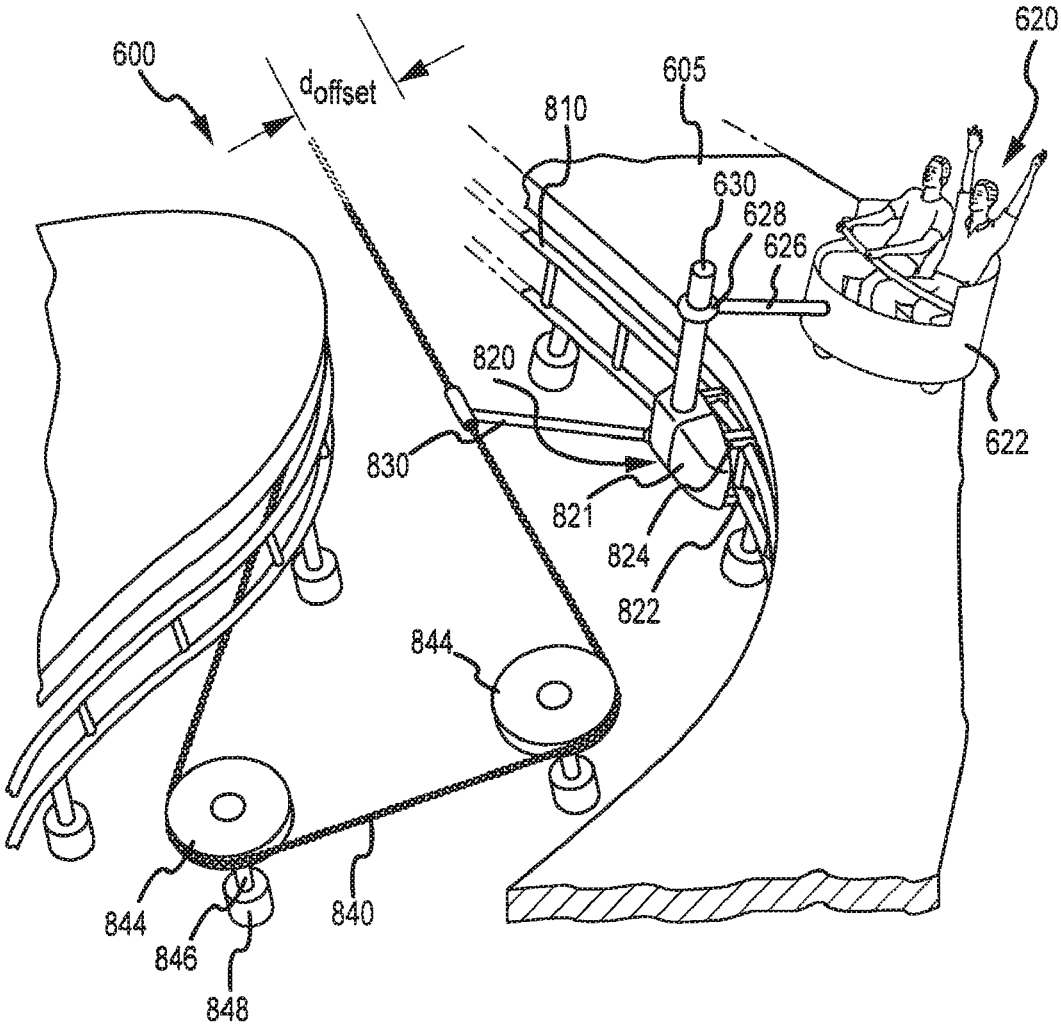
Figure 9:
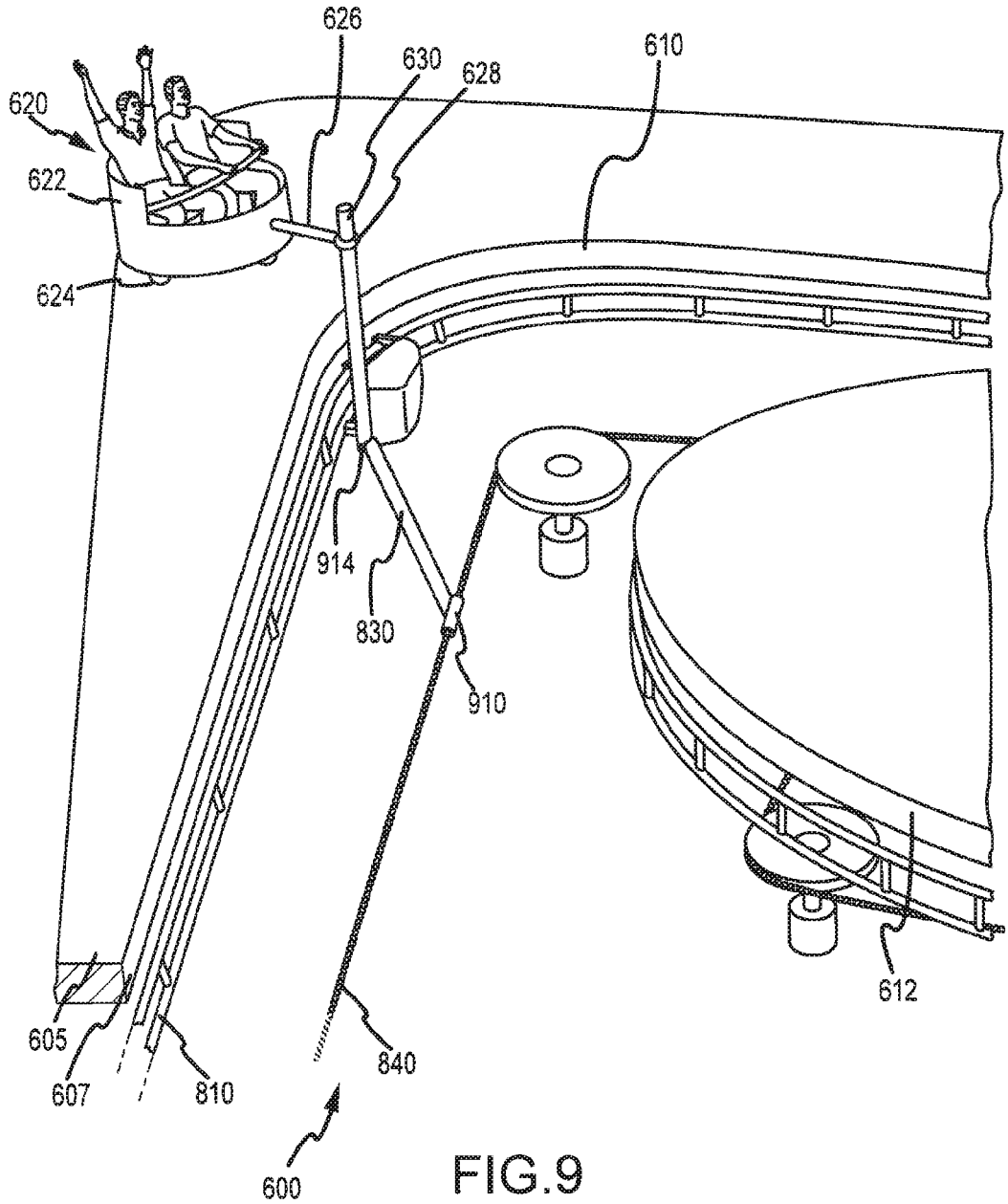

FIGS. 8 and 9 illustrate the ride system 600 with a portion of the surface 605 removed to show more details of an exemplary drive assembly used to whip the vehicle 620 as it moves along the courseline (e.g., whip in both counterclockwise or left direction and clockwise or right direction relative to the direction of travel and/or the connection arm or shaft 630). The drive assembly includes a bogie or drive truck 820 including a body 821 to which the connection arm or shaft 630 is attached and extends upward for connection to vehicle 620. The drive assembly includes a drive track 810 defining the path traveled by the bogie 820, which includes wheels or rollers 822, 824 to mount it upon the rails of track 810 and to rollably engage its surfaces (e.g., to allow the bogie 820 to readily move along the track 810 during operation of ride system 600). The bogie assembly 820 is connected or linked to a drive member 840 (e.g., a chain, a wire cable, a wire rope, a belt, or the like) via a pivotable connector 914 to an end of an arm or rod 830. The other end of the arm 830 is connected to the drive member 840 with a pivotable connector 910. Again, the connection used is selected to provide a connection strong enough to cause the arm 830 to move with drive member 840 and to pull bogie 820 along with vehicle 620 but also to allow the arm 830 to swivel about the member 840 (e.g., about its periphery) such as when there are changes in the offset distance, $d_{offset}$, e.g., a crossover location or portions of the system 600 in which it is desired to accelerate or decelerate the vehicle 620.

As shown, the drive member 840 is supported upon and driven by a series of pulleys 844 (although some of these may be idler pulleys simply providing support/guidance to the member 840). The pulleys 844 in turn are attached to shafts 846 and are driven by motors 848 attached to the shafts 846. For example, the pulleys 844 may be rotated so as to cause the drive member to move at about 5 to 8 feet per second, with some embodiments maintaining a relatively constant drive or input velocity and others using two or more input or drive speeds. The pulleys 844 may be coplanar or in differing planes but are generally all located below the track 810 such that the track 810 may crossover the drive member 840 (or its track, path, or travel profile in system 600) at least one point in the ride 600 to achieve inside curves and outside curves (e.g., offsets, $d_{offset}$, on both sides of the member 840) in a single ride. In addition to the offset distance, $d_{offset}$, being varied to achieve crossovers, it is also often useful to vary the separation of the rail 810 and bogie 820 to vary the speed of the bogie 820.

Figure 10:
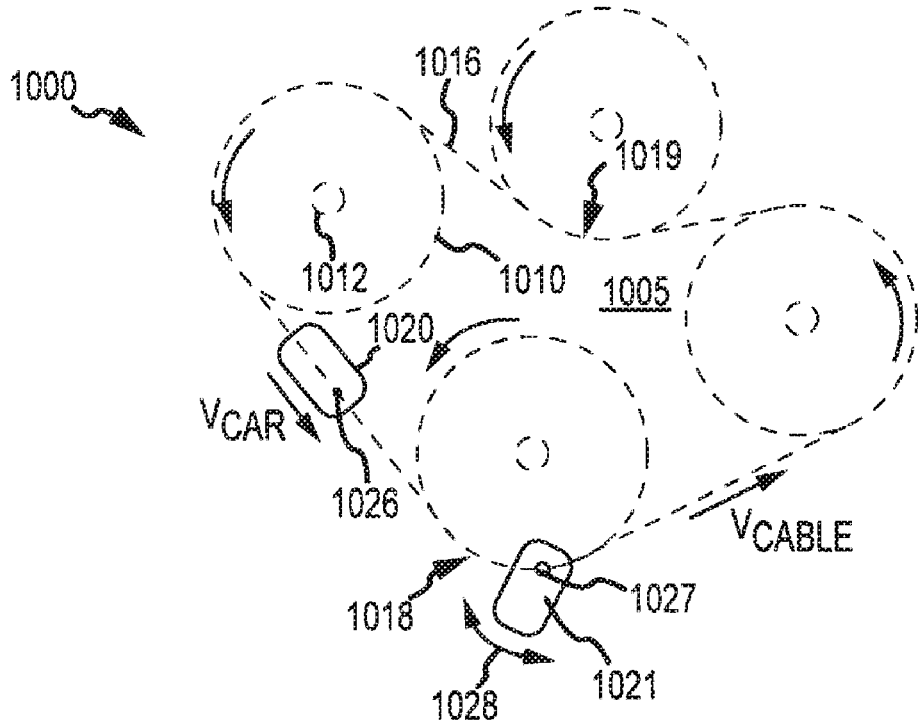
FIG. 10 illustrates a simplified top view of another embodiment of a ride assembly in which a vehicle (or at least a portion of it such as its trailing end) is allowed to cross over the guide slot as it pivots about it connection post or shaft that links it to a drive cable or chain.
Figure 11:
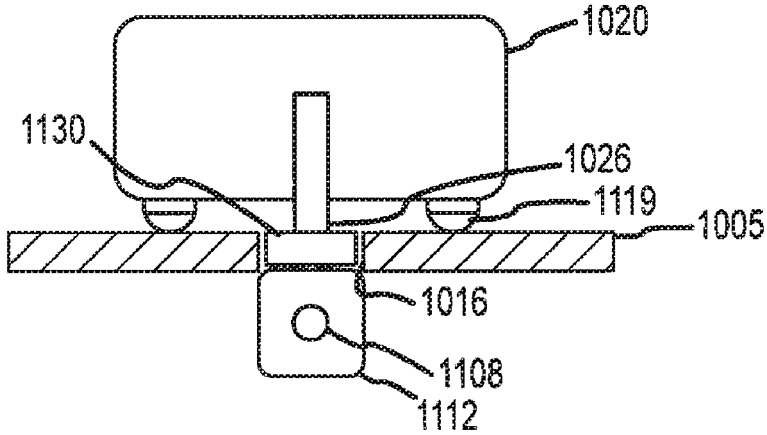
FIG. 11 is an end view of a vehicle on the ride assembly of FIG. 10 showing one useful connection technique pivotably linking a vehicle to a drive cable and allowing smooth crossover of the guide slot or groove in platform surface.

FIGS. 10 and 11 illustrate another ride system 1000 of an embodiment of the present invention. The ride system 1000 provides inside and outside turns or curves with a drive system similar to those found in FIGS. 1-9, but instead of a full whip effect provided by an offset the vehicle is typically driven on a path directly above the drive member or cable. During operation, the vehicle is able to pivot about an eccentrically positioned pivot post (e.g., an attachment to the drive cable that is provided near the front or lead portion of the vehicle such that the back or trailing end of the vehicle skid outward or side-to-side in curved portions of the ride courseline or path).

As shown in FIG. 10, the ride system 1000 includes a drive assembly including four pulleys or drive wheels 1010 rotating about shafts/motors 1012 (again, one or more may be idler or guide pulleys not driven by motors or the like). The drive assembly, including the pulleys 1010, is positioned beneath a ride platform or surface 1005. The drive assembly also includes a flexible drive member or cable (element 1108 in FIG. 11) that is driven or pulled at one or more drive velocities, VCABLE, such as 0 to 10 feet per second or more. The pulleys 1010 are arranged (such as to be coplanar at a distance below the backside of platform 1005) such that the path or profile followed by the drive member 1108 includes straight portions and also outside curves/corners 1018 as well as inside curves/corners 1019.

During operation, a pair of vehicles 1020, 1021 is shown to travel along with the cable 1016 at a velocity, $V_{CAR}$, which typically is the same as the cable velocity, $V_{CABLE}$, as the vehicles 1020, 1021 are directly linked via pivot posts 1026, 1027 to the cable or drive member 1108 through the opening groove or slot 1016 in the platform 1005. Wile traveling at the same velocity, though, the trailing end that often will contain the guests/passengers experiences tangential acceleration as the vehicle skids or fishtails around curves 1018, 1019 as shown with arrow 1028 (with skidding or rotation being in either direction depending upon the curve type such as counterclockwise for left turns which are outside curves in this embodiment with the vehicle proceeding counterclockwise about the courseline and clockwise for right turns which are inside cures).

FIG. 11 illustrates a detailed end view of a vehicle 1020 positioned on the ride surface 1005 and attached to the drive cable 1108 via guide slot 1016. Note, a groove cover 1130 may be provided, with a segmented plate or belt configuration as discussed with reference to FIGS. 1-9, to provide a smooth transition as the vehicle rotate about the post 1026 such that its back or trailing end swings back and forth over the guided slot 1016 in curves. As shown, the vehicle 1020 is linked to the pivot post 1026 such that it can pivot about it in curves (e.g., up to about 180 degrees or more about a longitudinal axis of the post 1026). Although not shown, a dampener assembly may be provided in such a pivotable connection to function to control the rate of swing (e.g., to avoid too fast a swing or skid), to control the amount or range of swing (e.g., a tension device or hard stop(s) to limit skid to less than about 90 degrees, less than about 45 degrees, less than about 30 degrees, or some other maximum one way swing (e.g., 90 degrees in either direction and so on)), and/or to return the vehicle back to the courseline such as with a resilient device that stretches to allow skid but has shape memory that pulls the vehicle back to a "normal" position along the courseline.

The vehicle 1020 may include wheels or casters 1119 that contact the surface 1005 and ride over the cover 1130 during skids or rotation movements or the entire vehicle may be cantilevered off the pivot post, eliminating the need for casters. The pivot post 1026 extends from the vehicle (or vehicle body) 1020 through guide slot 1016 and cover (or a plate of the cover assembly) 1130 where it is attached to the drive member 1108 (e.g., a cable or other flexible member such as a chain or belt that is driven by pulleys 1010). This attachment is typically a rigid or non-pivotable attachment such as may be provided with a cable clamp 1112 or the like that is rigidly affixed to both the cable 1108 and the post 1026 As can be seen from FIGS. 10 and 11, the pivot post 1026 is pivotably connected to the body of the vehicle 1020 eccentrically in that it is positioned forward on the vehicle (e.g., forward of the center of gravity of the vehicle body). In some case, the pivot post 1026 may be outside the vehicle body such as shown in FIGS. 1-9 with the connection of the whip vehicles to the connection shafts while in others it will be connected within a front or forward portion of the vehicle body such as in forward third, quarter, fifth, or the like (or with a preset distance from the front edge of the vehicle or a minimum distance from the center of the body or its center of gravity), with the important aspect for many embodiments being that the post is located forward of the center of gravity of the vehicle such that the trailing end or portions of the vehicle 1020 skid or rotate about the pivot post 1026 as shown in FIG. 10. Note, that a benefit of systems with the aspects of FIGS. 10 and 11 is that the vehicle may be pivoted about the vertical post, and, in some embodiments, may be attached as a cantilevered element/object. In such embodiments, it often will be useful to eliminate the casters/wheels (and, optionally, the guide slot cover) such that the vehicle may cross over the track centerline gap or guide slot without bumping over this slot (e.g., eliminating the ride continuity/smoothness reason for providing the cover).

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, the whip or towed vehicles have generally been shown in contact with a ride surface or platform such as with their wheels or casters contacting that surface to physically support the vehicles. However, such contact is not necessary to practice the invention, and it will be apparent to those in the arts that the breadth of the above description and following claims covers embodiments where the towed or whip vehicle is physically supported above the ride platform such as via its pivotable connection with the connection shaft or pivot post or the like. In such embodiments, the groove or slot may not be required or such cover may be provided more for passenger or guest safety or convenience. Vehicle-to-tow point connection could be made magnetically thus eliminating the need for a slot. The track path can take any number of configurations with various radius turns (both inside and out) as well as various lengths of straight track connecting the turns and/or curves may be tangentially connected.

Further, the ride assemblies are generally described as including a planar, horizontal ride platform with a drive assembly provided below this surface. Numerous other arrangements are possible including a planar, horizontal ride surface but with a drive assembly provided above the ride surface (or screen/ceiling). In such an embodiment, the vehicles may tide on the surface or may be suspended from a connection shaft while still experiencing the whipping effect or sliding/skid effect described herein with the various track/drive member offsets (e.g., the drive pulleys and flexible drive member would then be above the ride surface with the bogie or drive track positioned below the drive member but still vertically offset).

The invention claimed is:

1. A whip ride system for use in amusement parks and other settings, comprising:

a ride platform with a guide slot extending from an upper surface to a space beneath the ride platform;

a drive assembly comprising:

a drive member traveling along a first path, wherein the drive member is flexible;

a track arranged in a second path offset horizontally from the first path by an offset distance;

a bogie mounted for movement along the track and pivotably linked to the drive member to be driven on the track by the drive member; and an elongate connector attached to the bogie at a first end and extending through the guide slot, whereby a second end of the elongate connector is accessible from the upper surface; and a vehicle for receiving at least one passenger that is pivotably attached to the second end of the elongate connector, wherein the drive assembly comprises a plurality of pulleys contacting and supporting the flexible drive member and rotating at a rate to move the flexible drive member at an input velocity and wherein at least some of pulleys rotate in a plane that is substantially parallel to the upper surface, the track being positioned between the plane and the upper surface, and wherein the first and second paths each comprise inside and outside curves and wherein the bogie travels at a velocity greater than the input velocity in at least portions of the curves, whereby the attached vehicle experiences a whip effect.

2. The ride system of claim 1, wherein the first path comprises at least one inside curve and at least one outside curve and wherein the second path followed by the track is alternately positioned on both sides of the first path traveled by the drive member.

3. The ride system of claim 1, wherein the second path crosses the first path in at least one crossover location, the offset distance being zero at the crossover location.

4. The ride system of claim 3, wherein the track is vertically offset a distance from a plane containing the first path of the drive member, the track being positioned between the ride platform and the plane containing the first path.

5. The ride system of claim 4, wherein the bogie is pivotably linked to the drive member by an elongate, rigid arm that is pivotably mounted at one end to the bogie and at a second end to the drive member.

6. The ride system of claim 1, wherein the track comprises at least one rail and the bogie comprise two or more rolling members contacting the rail to vertically support the bogie and facilitate the bogie rolling on the track in response to movement of the flexible drive member.

7. The ride system of claim 1, wherein the offset distance is varied in a length of corresponding portions of the first and second paths to vary a velocity of the bogie and the attached vehicle relative to the input velocity of the flexible drive member.

8. The ride system of claim 1, further comprising a cover assembly for the guide slot including a plurality of plates pivotably linked together, the guide slot including a recessed surface for receiving the plates and at least one of the plated being linked to the vehicle or the elongate connector.

9. The ride system of claim 1, wherein the vehicle is connected to the elongate connector at an eccentric location relative to a center portion of the vehicle, whereby the vehicle rotates about the elongate connector as the bogie connected to the elongate connector travels on a curved portion of the second path of the track.

10. An assembly for use in providing a ride for an amusement park, comprising:

a drive assembly comprising a drive member driven at an input velocity along a path, wherein the path comprises at least one inside curve and at least one outside curve;

a ride platform with a guide slot defining a courseline for the ride; and a vehicle with a body for receiving at least one passenger, wherein the ride platform is disposed between the vehicle and the drive assembly and wherein the vehicle is pivotably attached to the drive member via a connector extending through the guide slot at a mounting point on the body offset from a center of the body, whereby the body of the vehicle pivots about the mounting point when the vehicle travels on the curves, wherein the drive assembly further comprises:

a track arranged in a path offset horizontally from the drive member path by an offset distance; and a drive truck mounted for rolling on the track and pivotably linked to the drive member to be driven on the track by the drive member, wherein the connector is pivotably attached to the drive truck, and wherein the offset distance is varied in a length of adjacent portions of the paths to vary a velocity of the drive truck and the attached vehicle relative to the input velocity of the drive member.

11. The assembly of claim 10, wherein the vehicle comprises casters mounted extending out from the body to contact the ride platform and the assembly further comprising a cover assembly for the guide slot including a plurality of plates pivotably linked together, the guide slot including a recessed surface for receiving the plates and at least one of the plates being linked to the vehicle or the connector.

12. The assembly of claim 10, wherein the offset distance varies from zero to at least about 10 feet.

13. The assembly of claim 12, wherein the track path crosses the drive member path in at least one crossover location, the offset distance being zero at the crossover location.

14. The assembly of claim 10, wherein the track is vertically offset a distance from a plane containing the drive member path, the track being positioned between the ride platform and the plane containing the drive member path.

15. The assembly of claim 10, wherein the drive truck is pivotably linked to the drive member by an elongate, rigid arm that is pivotably mounted at one end to the drive truck and at a second end to the drive member.

16. An amusement park ride comprising:

a ride platform with a contact surface and a guide slot extending along a portion of the contact surface in a loop with at least one outside curve and at least one inside curve;

a flexible drive member driven by a set of pulleys in a drive path at a drive velocity;

a bogie pivotably connected to the flexible drive member and mounted to ride upon a track that is vertically offset from the drive path; and a vehicle positioned on the contact surface of the ride platform and pivotably connected to a connector extending from the bogie through the guide slot, wherein the track is positioned between the drive path and the ride platform, wherein the track is arranged to have a path substantially matching the loop defined by the guide slot and horizontally offset from the drive path, and wherein the track path crosses over the drive path when viewed from platform, the vertical offset being selected such that the track and the bogie are spaced apart from the drive member at any of the crossovers.

17. The amusement park ride of claim 16, wherein the vehicle is eccentrically connected to the connector, wherein the horizontal offset is selected whereby a velocity of the bogie substantially exceeds the input velocity on the curves, and wherein at least a trailing end of the body of the vehicle rotates relative to the direction of travel along the loop defined by the guide slot in the curves.

18. A whip ride system for use in amusement parks and other settings, comprising:

a ride platform with a guide slot extending from an upper surface to a space beneath the ride platform;

a drive assembly comprising:

a drive member traveling along a first path;

a track arranged in a second path offset horizontally from the first path by an offset distance;

a bogie mounted for movement along the track and pivotably linked to the drive member to be driven on the track by the drive member; and an elongate connector attached to the bogie at a first end and extending through the guide slot, whereby a second end of the elongate connector is accessible from the upper surface;

a vehicle for receiving at least one passenger that is pivotably attached to the second end of the elongate connector; and a cover assembly for the guide slot including a plurality of plates pivotably linked together, the guide slot including a recessed surface for receiving the plates and at least one of the plated being linked to the vehicle or the elongate connector.

19. The ride system of claim 18, wherein the first path comprises at least one inside curve and at least one outside curve and wherein the second path followed by the track is alternately positioned on both sides of the first path traveled by the drive member.

20. The ride system of claim 18, wherein the second path crosses the first path in at least one crossover location, the offset distance being zero at the crossover location.

21. The ride system of claim 20, wherein the track is vertically offset a distance from a plane containing the first path of the drive member, the track being positioned between the ride platform and the plane containing the first path.

22. The ride system of claim 21, wherein the bogie is pivotably linked to the drive member by an elongate, rigid arm that is pivotably mounted at one end to the bogie and at a second end to the drive member.

23. The ride system of claim 18, wherein the track comprises at least one rail and the bogie comprise two or more rolling members contacting the rail to vertically support the bogie and facilitate the bogie rolling on the track in response to movement of the flexible drive member.

24. The ride system of claim 18, wherein the vehicle is connected to the elongate connector at an eccentric location relative to a center portion of the vehicle, whereby the vehicle rotates about the elongate connector as the bogie connected to the elongate connector travels on a curved portion of the second path of the track.

25. An assembly for use in providing a ride for an amusement park, comprising:

a drive assembly comprising a drive member driven at an input velocity along a path, wherein the path comprises at least one inside curve and at least one outside curve;

a ride platform with a guide slot defining a courseline for the ride; and a vehicle with a body for receiving at least one passenger, wherein the ride platform is disposed between the vehicle and the drive assembly and wherein the vehicle is pivotably attached to the drive member via a connector extending through the guide slot at a mounting point on the body offset from a center of the body, whereby the body of the vehicle pivots about the mounting point when the vehicle travels on the curves, wherein the vehicle comprises casters mounted extending out from the body to contact the ride platform and the assembly further comprising a cover assembly for the guide slot including a plurality of plates pivotably linked together, the guide slot including a recessed surface for receiving the plates and at least one of the plates being linked to the vehicle or the connector.

26. The assembly of claim 25, wherein the drive assembly further comprises:

a track arranged in a path offset horizontally from the drive member path by an offset distance; and a drive truck mounted for rolling on the track and pivotably linked to the drive member to be driven on the track by the drive member, wherein the connector is pivotably attached to the drive truck.

27. The assembly of claim 26, wherein the offset distance varies from zero to at least about 10 feet.

28. The assembly of claim 26, wherein the track path crosses the drive member path in at least one crossover location, the offset distance being zero at the crossover location.

29. The assembly of claim 26, wherein the track is vertically offset a distance from a plane containing the drive member path, the track being positioned between the ride platform and the plane containing the drive member path.

30. The assembly of claim 26, wherein the drive truck is pivotably linked to the drive member by an elongate, rigid arm that is pivotably mounted at one end to the drive truck and at a second end to the drive member.

* * * * *

UNITED STATES PATENT AND TRADEMARK OFFICE

CERTIFICATE OF CORRECTION

PATENT NO. : 7,685,944 B2
APPLICATION NO. : 12/110040
DATED : March 30, 2010
INVENTOR(S) : Kilbert et al.

It is certified that error appears in the above-identified patent and that said Letters Patent is hereby corrected as shown below:

Column 5, line 64, delete "160", and insert therefor --180--.

Signed and Sealed this

Eighteenth Day of May, 2010

David J. Kappos

David J. Kappos
*Director of the United States Patent and Trademark Office*